US005974947A

United States Patent [19]

Noda

[11] Patent Number: 5,974,947

[45] Date of Patent: Nov. 2, 1999

[54] RODLESS POWER CYLINDER

[75] Inventor: Mitsuo Noda, Ichinomiya, Japan

[73] Assignee: Howa Machinery, Ltd., Nagoya, Japan

[21] Appl. No.: 09/014,655

[22] Filed: Jan. 28, 1998

[30] Foreign Application Priority Data

Apr. 29, 1997 [JP] Japan ..... 9-126359

[51] Int. Cl.[6] ..... F01B 29/00

[52] U.S. Cl. ..... 92/88; 277/DIG. 7

[58] Field of Search ..... 92/88; 277/DIG. 7

[56] References Cited

U.S. PATENT DOCUMENTS

| | | | |
|---|---|---|---|
| 4,252,285 | 2/1981 | Hammond et al. | 92/88 X |
| 4,601,234 | 7/1986 | Hoinkis | 92/88 |
| 5,245,910 | 9/1993 | Drittel | 92/88 |
| 5,330,272 | 7/1994 | Stoll | 92/88 X |
| 5,606,903 | 3/1997 | Drittel | 92/88 |

FOREIGN PATENT DOCUMENTS

| | | |
|---|---|---|
| 3-4005 | 1/1991 | Japan . |
| 5-65906 | 3/1993 | Japan . |
| 5-106612 | 4/1993 | Japan . |

*Primary Examiner*—Hoang Nguyen
*Attorney, Agent, or Firm*—Finnegan, Henderson, Farabow, Garrett & Dunner, L.L.P.

[57] ABSTRACT

According to the rodless power cylinder of the present invention, a pressure relieving passage which opens to the space between the inner seal band and the outer seal band at one end, and to the outside of the cylinder barrel at the other end is provided in the end cap of the cylinder barrel. Further, a cap cover is provided on the end cap. The cap cover includes a valve element portion which resiliently fits into the end of the relieving passage opening to the outside. When the pressure in the space between the seal bands increases to a predetermined level due to leak of the inner seal band, the valve element opens outward due to the pressure in the relieving passage to allow the fluid in the space to escape to the outside. Thus, the pressure in the space between the seal bands are kept at a low level even if a leak in the inner seal band occurs and, thereby, a blow off of the outer seal band and damage to the rodless power cylinder is prevented.

14 Claims, 6 Drawing Sheets

RODLESS POWER CYLINDER

BACKGROUND OF THE INVENTION

1. Field of the Invention

The present invention relates to a rodless power cylinder having inner and outer seal bands for sealing a slit on the cylinder barrel.

2. Description of the Related Art

A rodless power cylinder includes a cylinder barrel having an axial slit on the wall and a piston disposed in the bore of the cylinder barrel. The bore of the cylinder barrel is divided by the piston and forms two pressure chambers on both side of the piston. The piston is moved within the bore by introducing pressurized fluid into the pressure chambers. The movement of the piston is transferred to an external carriage by a coupling member which connects the carriage to the piston through the slit of the cylinder barrel. Usually, an inner seal band and an outer seal band covering the slit from inside and outside of the cylinder barrel are provided in order to prevent leakage of the pressure fluid the cylinder bore and an incursion of dust into the cylinder bore.

The rodless power cylinder of this type is, for example, disclosed in Japanese Unexamined Patent Publication (Kokai) No. 5-65906.

The rodless power cylinder in the '906 publication has an inner seal band covering the opening of the slit on the wall of the bore of the cylinder barrel and a dust seal band (an outer seal band) covering the opening of the slit on the outer surface of the cylinder barrel. The inner seal band has lip portions for preventing the leakage of the fluid by contacting the inner surface of the bore. Further, the inner seal band in the '906 publication is provided with an additional land near the end of the each lip portion. By providing the additional lands on the inner seal band, the fluid leaking from the lip portions due to insufficient seal function thereof is trapped in the space between the lands and the ends of the lip portions. Namely, the inner seal band of the '906 publication has a dual-seal construction to improve a seal performance. The both ends of the inner seal band are secured to end caps (end plates) disposed on both ends of the cylinder barrel, and the outsides of the end caps are covered by additional end caps. A small amount of the fluid leaking from the lip portions of the inner seal band and trapped in the space between the ends of the lip portions and the lands can escape to the outside of the cylinder barrel through small clearances between the inner seal band and the end caps or the end caps and the additional end caps.

Japanese Unexamined Patent Publication (Kokai) No. 5-106612 discloses a rodless power cylinder of similar type. The inner and outer packing belts (seal bands) are both secured by blocks fixed to the both ends of the cylinder tube (cylinder barrel). The space between the packing belts communicates with the outside of the cylinder barrel via a hole disposed on the block. The pressure in the space is maintained at a negative pressure or a positive pressure by connecting the space to an appropriate positive or negative pressure source through the hole of the blocks. When the pressure in the space between the inner and outer packing belts is maintained at a positive pressure by supplying pressurized air through the hole, the incursion of dust into the space is prevented. When the pressure in the space between the inner and outer packing belt is maintained at a negative pressure by extracting air in the space through the hole, contaminants contained in the pressurized air supplied to the bore of the cylinder do not leak to the atmosphere.

Further, Japanese Unexamined Patent Publication (Kokai) No. 3-4005 discloses a rodless power cylinder in which the end portions of the inner seal band and the outer seal band are fixed to the end caps of the cylinder barrel by inserting the end portions into holes penetrating the end caps of the cylinder barrel. As a result, the space between the seal bands is directly open to the atmosphere through the holes in the end caps.

However, the '906 publication considers the case where a very small amount of fluid leaks from the cylinder bore through the inner seal band. Therefore, if a large amount of the fluid flows into the space between the land and the end of the lip portion, for example, due to a failure of the lip seal portion, the fluid flows into the space between the inner seal band and the outer seal band. This causes a pressure rise in the space between the inner and outer seal bands and, if the pressure in the space exceeds a certain pressure, the outer seal band is blown off by the pressure in the space. In this case, the rodless power cylinder is damaged.

In the rodless power cylinder in the '612 publication, the time required for the pressure to increase in the space between the inner and the outer packing belt may become longer if the space is maintained at a negative pressure. However, if a large amount of air flows into the space between the packing belts, the pressure in the space increases and a blow off of the outer packing belt occurs.

In the rodless power cylinder of the '005 publication, since the space between the seal bands directly opens to the atmosphere, a blow off of the outer seal belt does not occur even if the inner seal band fails. In this case, however, an incursion of dust into the space between the seal band through the holes in the end caps occurs and seal bands may be damaged by the dust.

SUMMARY OF THE INVENTION

In view of the problems in the related art as set forth above, the objects of the present invention are to provide a simple and effective means for preventing damage to the rodless power cylinder when a large amount of fluid leaks from the inner seal band and flows into the space between the seal bands while preventing damage caused by the incursion of dust into the space between the seal bands.

These objects are achieved by the rodless power cylinder of the present invention which comprises a cylinder barrel provided with a slit which penetrates the wall of the cylinder barrel and extends parallel to the axis of the cylinder barrel, a piston member having two ends disposed in the bore of the cylinder barrel and movable therein in the axial direction, pressure chambers defined by the piston within the bore of the cylinder barrel on both sides of the piston for receiving pressurized fluid therein, an external carriage disposed outside of the cylinder barrel and coupled to the piston by a coupling member through the slit of the cylinder barrel so that the carriage moves with the piston member along the slit, an inner seal band disposed on the wall of the bore of the cylinder barrel along the slit in such a manner that the opening of the slit on the wall of the bore of the cylinder barrel is covered by the inner seal band, an outer seal band disposed on the outer surface of the cylinder barrel along the slit in such a manner that the opening of the slit on the outer surface of the cylinder barrel is covered by the outer seal band, and pressure relieving means for relieving the fluid in the space between the inner seal band and the outer seal band, wherein the pressure relieving means isolates the space from the outside of the cylinder barrel when the pressure in the space is lower than a predetermined value and relieves fluid in the space to the outside of the cylinder barrel when the pressure in the space reaches the predetermined value.

According to the present invention, the relieving means isolates the space between the seal bands from the outside of the cylinder barrel when the pressure in the space is lower than the predetermined value. Therefore, the incursion of dust into the space is prevented. However, when the pressure in the space between the seal bands increases to the predetermined value, for example, due to the failure of the inner seal bands, the relieving means relieves the fluid in the space to the outside of the cylinder barrel. Therefore, the pressure in the space decreases and is kept lower than the predetermined value. This prevents a blow off of the outer seal band and damage to the rodless power cylinder.

According to one aspect of the present invention, the relieving means comprises a relieving passage and a pressure relieving valve, and the pressure relieving valve is provided with indicating means for indicating whether the pressure relieving valve is open.

Therefore, the operator of the machine using the rodless power cylinder is clearly notified of the fact that the pressure in the space between the seal bands has increased. The valve element of the pressure relieving means may be used as the indicating means.

BRIEF DESCRIPTION OF THE DRAWINGS

The present invention will be better understood from the description as set forth hereinafter, with reference to the accompanying drawings in which.

DESCRIPTION OF THE PREFERRED EMBODIMENT

Figure 1:
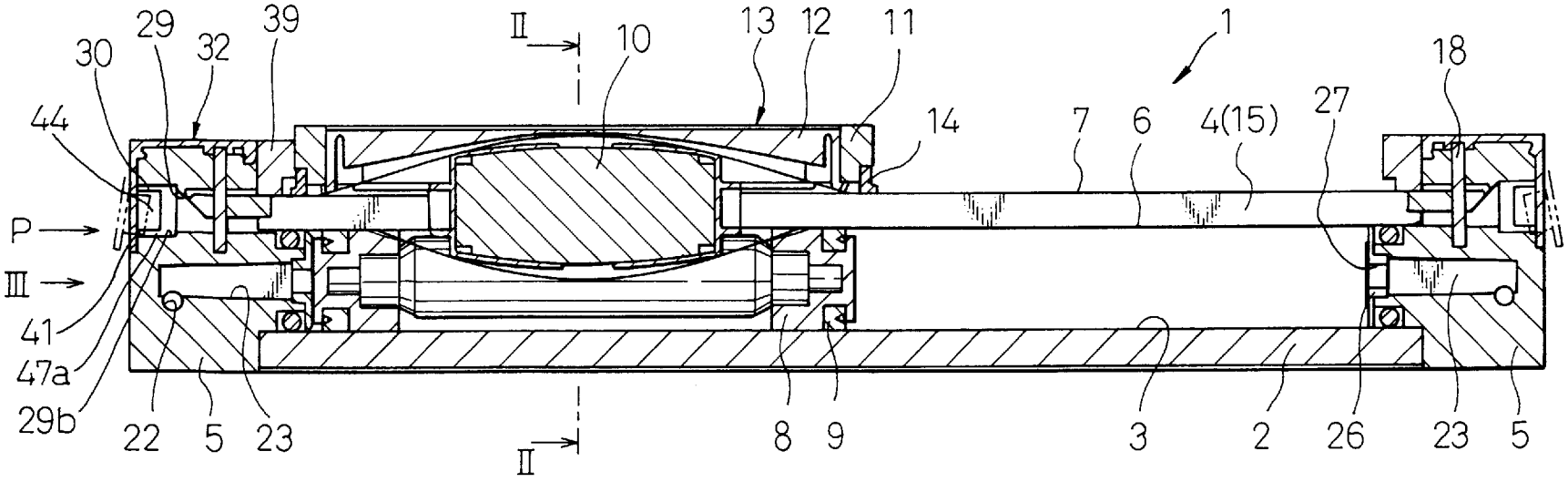
FIG. 1 is a longitudinal section view of a rodless power cylinder according to an embodiment of the present invention.

FIGS. 1 through 7 show an embodiment of a rodless power cylinder according to the present invention. In FIG. 1, reference numeral 1 designates a rodless power cylinder as a whole. Numeral 2 in FIG. 1 shows a cylinder barrel of the rodless power cylinder 1 which is formed by, for example, extrusion of aluminum alloy. The cylinder barrel 2 in FIG. 1 has a rectangular cross section and a cylinder bore 3 of an elliptical cross section is formed in the cylinder barrel 2.

A slit 4 is provided on the side wall of the cylinder barrel 2 along the entire length thereof. The respective ends of the cylinder barrel 2 are closed by end caps 5 inserted into the cylinder bore 3. An inner seal band 6 and an outer seal band 7 which cover the opening of the slit on the inner surface of the cylinder bore 3 and on the surface of the cylinder barrel 2, respectively are disposed along the entire length of the slit 4. The seal bands 6 and 7 are secured at the end portions thereof to the end caps 5.

Figure 2:
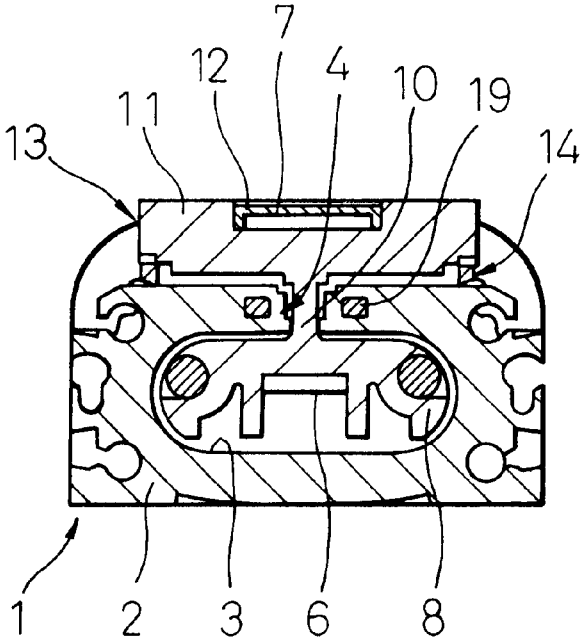
FIG. 2 is a cross sectional view taken along the line II—II in FIG. 1.
Figure 3:
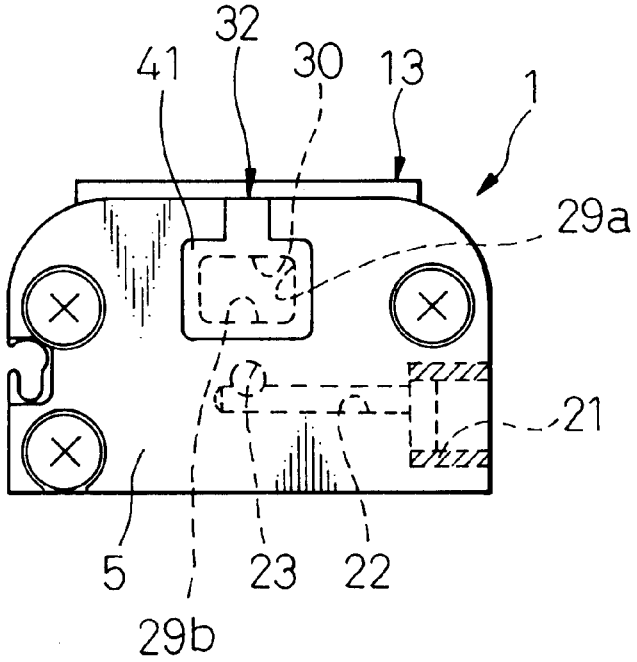
FIGS. 3 is an end view of the rodless power cylinder in FIG. 1 when viewed from the direction indicated by the arrow III in FIG. 1.

In the bore 3 of the cylinder barrel 2, a piston 8, which is movable along the longitudinal axis of the cylinder barrel 2, is disposed. The piston 8 is provided with piston packings 9 at the both ends thereof. Therefore, two pressure chambers are defined in the bore 3 of the cylinder barrel 2 by the piston 8 on both sides thereof. In this embodiment, a part of the piston 8 forms a piston yoke 10 which protrudes to the outside of the cylinder barrel 2 through the slit 4. As shown in FIGS. 1 and 2, a mount 11 is constructed as an integral part of the yoke 10 and a mount cover 12 is fitted on the mount 11 at the center thereof. The mount 11 and the mount cover 12 in this embodiment form an external carriage 13, and the yoke 10 forms a coupling member for connecting the carriage 13 to the piston 8. The inner seal band 6 and the outer seal band 7 are guided by guide surfaces formed in the upper side and the lower side of the yoke 10, respectively, and run through the yoke 10. A scraper 14 is attached to the external carriage 13 around the lower periphery thereof in order to prevent the incursion of dust into the space between the cylinder barrel 2 and the carriage 13. Numeral 39 is a mount damper fixed to the end cap 5 at the portion above the cylinder barrel 2.

In FIG. 1, numeral 15 designates a space defined in the slit 4 by the inner seal band 6, the outer seal band 7, the mount 11 and the piston 8. The seal bands 6 and 7 are bands wider than the width of the slit 4 and made of a magnetic metal such as steel belts. Both ends of the seal bands 6 and 7 are provided with fitting holes and are secured to the end caps 5 by pins 18 passing through the fitting holes. Further, in this embodiment, magnetic strips 19 are disposed on both sides of the slit 4 along the entire length thereof as shown in FIG. 2. Therefore, the seal bands 6 and 7 are attracted to the magnetic strips 19 and seal the slit 4 from upper and lower sides thereof. The fitting hole at one end of the outer seal band 7 is formed as a circular hole fitting to the shape of the cross section of the pin 18 and the fitting hole at the other end of the outer seal band 7 is formed as an oblong circular hole in order to permit a relative movement between the pin 18 and the outer seal band 7. Therefore, the outer seal band is capable of deflecting outward against the attracting force of the magnet strips 19 when the pressure in the space 15 increases to a certain level, in order to allow the fluid in the space 15 to escape through the clearance between the cylinder barrel 2 and the outer seal band 7 caused by the deflection. When the pressure in the space 15 decreases due to the fluid escaping therefrom, the outer seal band again adheres to the slit by the attracting force of the magnetic strip 19 in order to seal the space 15. Therefore, the outer seal band 7 in this embodiment, which is provided with an oblong circular hole, is also capable of functioning as a relieving means.

However, the inner seal band 6 and the outer seal band 7 can be secured by other methods as long as a space 15 is formed between the seal bands. For example, the seal bands 6 and 7 may be made of an elastic material such as urethane or polyamide. In this case, both ends of the seal bands 6 and 7 are tightly fixed to the end caps 5, and the seal bands 6 and 7 adhere to and deflect from the slit 4 due to the elasticity of the bands.

Figure 4:
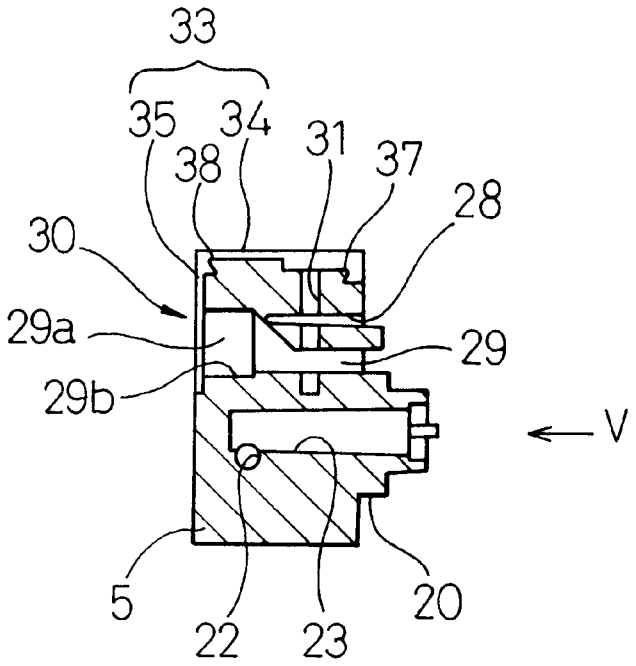
FIG. 4 is a sectional view of the end cap of the rodless power cylinder in FIG. 1.
Figure 5:
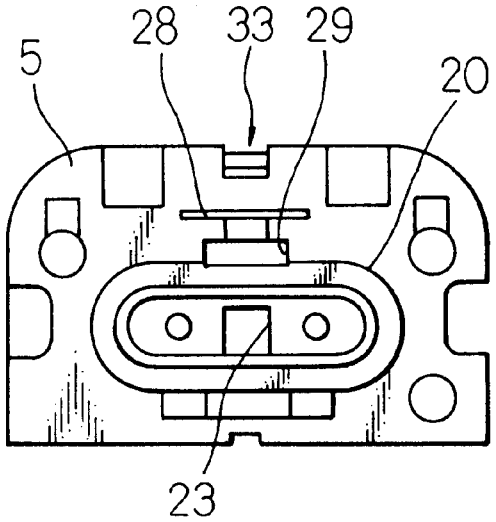
FIG. 5 is an end view of the end cap in FIG. 4 when viewed from the direction indicated by the arrow V in FIG. 4.

FIGS. 4 and 5 show the end cap 5 in FIG. 1. As shown in the drawing, the end cap 5 is provided with a plug portion 20 which has an elliptical cross section and is inserted into the bore 3 of the cylinder barrel 2. A fluid supply and outlet port 21 is provided on one of the lateral faces of the end cap 5. The port 21 is connected to a fluid passage 23 extending in the longitudinal direction of the cylinder barrel 2 via another fluid passage 22 extending in the direction vertical to the passage 23. A piston damper 26 is fitted to the tip of the plug portion 20 of the end cap 5, as best shown in FIG. 1, so that the piston 8 abuts thereto at the end of the piston stroke. The piston damper 26 is provided with an inlet/discharge port 27 at the center thereof. The port 27 is connected to the fluid passage 23. Numeral 28 in FIG. 4 is a recess for accommodating the end portion of the outer seal band 7. Further, a relieving passage 29 passes through the end cap 5. This relieving passage 29 accommodates the end portion of the inner seal band 6 and also communicates with the space 15 between seal bands 6 and 7. The relieving passage 29 ends at the opening 30 on the outer end face of the end cap 5 which opens to the outside of the cylinder barrel 2. Numeral 31 in FIG. 4 shows a hole extending vertically from the upper face of the end cap 5. The hole 31 crosses the recess 28 and the passage 29 and accommodates the pin 18 for securing the inner seal band 6 and the outer seal band 7 to the walls of the passage 29 and recess 28, respectively. A fitting groove 33 for fitting a cap cover 32 is formed on the upper face and the outer end face of the end cap 5. The cap cover 32 in this embodiment acts as both a pressure relieving valve and a stop valve for isolating the relieving passage 29 from the outside of the cylinder barrel 2. The fitting groove 33 is composed of a groove 34 formed on the center of the upper face of the end cap 5 and a wide groove 35 formed on the center of the outer end face of the end cap 5. The end portion of the groove 34 is provided with engaging portions 37 and 38 for fitting the cap cover 32.

Figure 6:
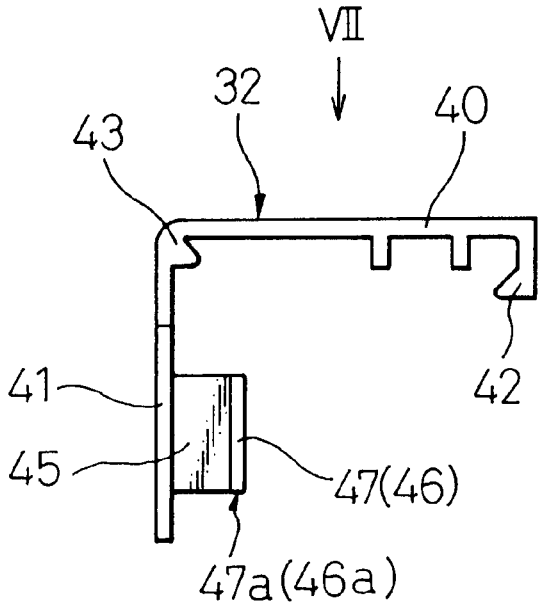
FIG. 6 is a side view of the end cap cover of the rodless power cylinder in FIG. 1.
Figure 7:
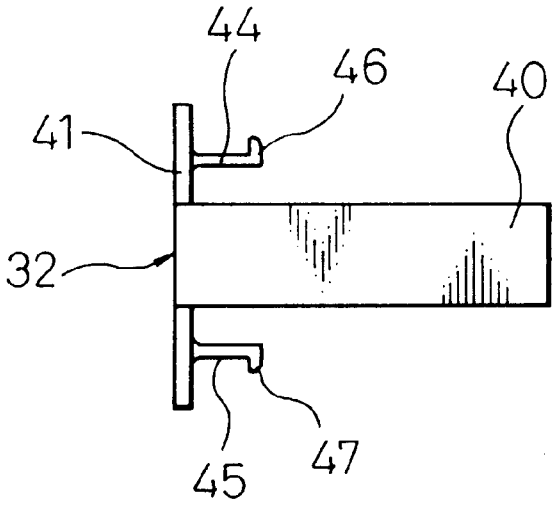
FIG. 7 is a view of the end cap cover in FIG. 6 when viewed from the direction indicated by the arrow VII in FIG. 6.

The cap cover 32 is made of an elastic material. For example, the cap cover 32 may be made of synthetic resin such as polypropylene. FIGS. 6 and 7 show the cap cover 32. The cap cover 32 is composed of an engaging member 40 for fitting to the engaging portions 37 and 38 of the groove 34 and, a valve element 41 formed vertical to the engaging member 40 for fitting to the wide groove 35.

The engaging member 40 is provided with hooks 42 and 43 which engage with the engaging portions 37 and 38, respectively, in order to secure the cap cover 32 to the end cap 5. The engaging member 40 also acts as a stopper for preventing the pin 18 from coming out from the hole 31. The valve element 41 is provided with fitting members 44 and 45 which extend inward and parallel to the engaging member 40. Further, at the end portions thereof, the fitting members 44 and 45 are provided with hooks 46 and 47 facing outward direction opposite to each other. The distance between the hooks 46 and 47 is larger than the width of the relieving passage 29 and, when the fitting members 44 and 45 are inserted into the passage 29, the hooks 46 and 47 urge the wall surface 29*a* of the passage 29 outward resiliently. Thus, the valve element 41 is tightly fitted to the relieving passage 29. The cap cover 32 is fitted to the groove 33 of the end cap 5, through the engagement of hooks 42, 43 with engaging portions 37, 38, and the valve element 41 closes the opening 30 of the relieving passage 29 through the engagement of hooks 46, 47 with the wall surface 29*a* of the passage 29.

When a pressurized fluid (in this embodiment, pressurized air) is supplied to a pressure chamber in the cylinder bore 3 at one side of the piston 8 through the supply and outlet port 21, the piston 8 moves from one end of the cylinder bore 3 to the other, and at the end of the piston stroke, the piston 8 and the external carriage 13 abut the piston damper 26 and the mount damper 39, respectively. When the piston 8 stops, the pressurized fluid supplied to the cylinder bore 3 from the port 21 leaks into the space 15 through the inner seal band 6. However, since the amount of the fluid passing through the inner seal band 6 is relatively small, and since the fluid in the space 15 leaks to the atmosphere through the outer seal band 7, the pressure in the space 15 between seal bands 6 and 7 does not increase and is kept at near the atmospheric pressure. In this condition, the valve element 41 stays at the opening 30 of the relieving passage 29 and prevents dust from intruding into the space 15.

However, when the amount of the fluid passing through the inner seal band 6 increases over a short time, the amount of the fluid passing through the inner seal band 6 becomes considerably larger than the amount of the fluid escaping through the outer seal band 7, and the pressure in the space 15 increases. When the pressure in the space 15 reaches to a predetermined pressure determined by the engagement between the hooks 46, 47 of the valve element 41 and the wall 29*a* of the passage 29, the valve elements 41 on both sides of the cylinder barrel 2 disengage from the walls 29*a* by the pressure in the passage 29 and uncover the openings 30 of the passages 29 on both sides of the cylinder barrel 2. In this condition, since a large amount of fluid can flow out to the ambient through the relieving passages 29 on both sides of the cylinder barrel 2, the pressure in the space 15 decreases to the value near the atmospheric pressure. Thus, a blow off of the outer seal band 7 does not occur.

When the valve element 41 opens outward by the pressure in the passage 29, the bottom parts 46*a* and 47*a* of the tips of the hooks 46 and 47 make contact with the bottom surface 29*b* of the passage 29 in order to prevent further outward movement of the valve element 41. Therefore, the valve elements 41 are kept at the positions P indicated in FIG. 1 regardless of the resilience of the cap cover 32 and indicate that the relieving passage 29 is open. Namely, the valve element 41 functions as the indicating means for indicating whether the pressure in the space 15 has risen to the predetermined pressure.

When it is found that the valve elements 41 are at the opening positions P in FIG. 1, the rodless power cylinder 1 must be inspected to determine whether repair or replacement of the cylinder 1 is required. If it is determined that the rodless power cylinder 1 is not damaged, the cylinder 1 can be reused by pushing the fitting members 44 and 45 of the valve elements 41 into the relieving passage 29 to close the opening 30 thereof.

The predetermined pressure at which the valve element 41 disengages is set at a value lower than the pressure at which a blow off of the outer seal band 7 occurs, however, this pressure is set at a value largely higher than the highest pressure in the space 15 during the normal operation of the rodless power cylinder 1.

Figure 8:
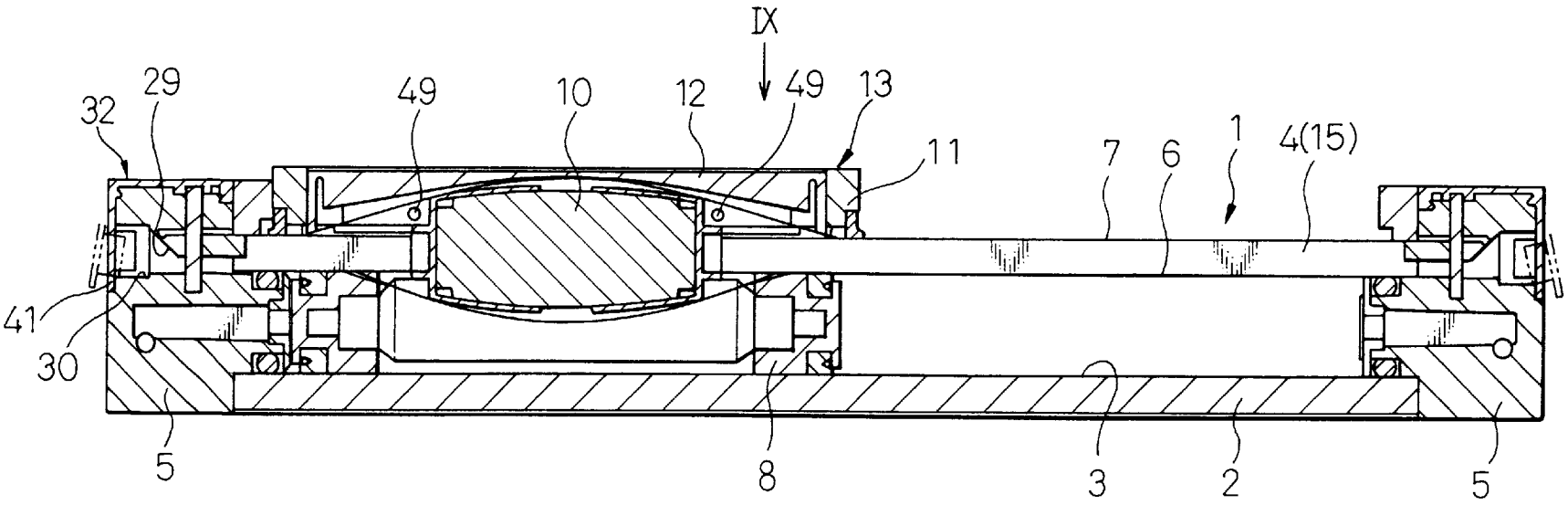
FIG. 8 is a longitudinal section view of a rodless power cylinder according to another embodiment of the present invention.
Figure 9:
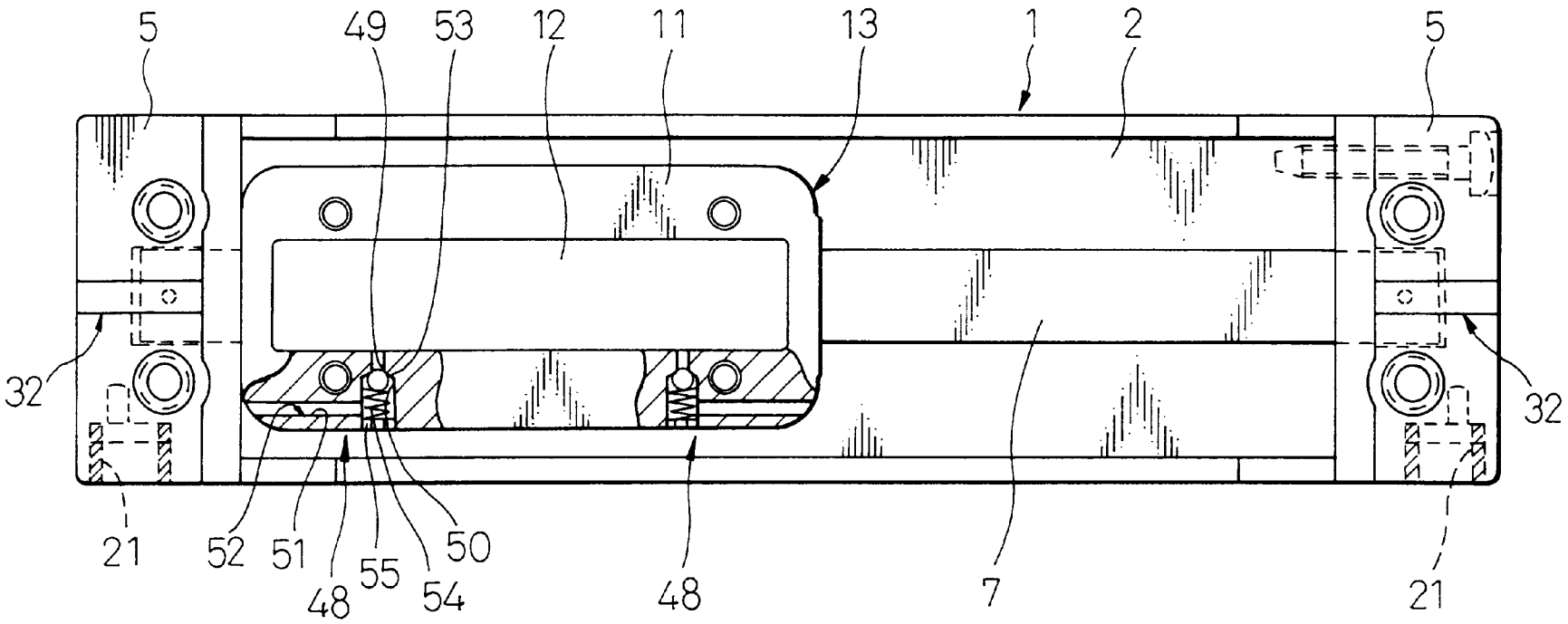
FIG. 9 is a view of the rodless power cylinder in FIG. 8 when viewed from the direction indicated by the arrow IX in FIG. 8.

Next, another embodiment of the present invention is explained with reference to FIGS. 8 and 9. In FIGS. 8 and 9, reference numerals the same as those in FIGS. 1 through 7 designate similar elements.

In this embodiment, a second pressure relieving valve 48 is disposed on the mount 11 in addition to the pressure relieving valves (i.e., end cap covers) 32 disposed on both ends of the cylinder barrel 2.

As shown in FIGS. 8 and 9, the mount 11 in this embodiment is provided with a fluid passage 49 extending in the direction along the width of the cylinder barrel 2. One end of the fluid passage 49 opens to the space 15 at a position between the portion of the yoke 10 where the outer seal band 7 passes through the yoke 10 and the upper face of the cylinder barrel 2. As shown in FIG. 9, the other end of the passage 49 is connected to a valve space 50 which accommodates a valve element (a steel ball) 53 and a spring 54 urging the valve element 53 to the position blocking the passage 49. The valve space 50 is, then, connected to another fluid passage 51 extending in the longitudinal direction of the cylinder barrel 2 and opening to the outside of the cylinder barrel 2. Namely, the fluid passages 49 and 51 in this embodiment form a second relieving passage 52, and the ball 53 and the spring 54 form a second pressure relieving valve 48. Numeral 55 in FIG. 9 designates a plug for closing the valve space 50 after fitting the ball 53 and spring 54 into the space 50.

In this embodiment, when the pressure in the space 15 increases to the predetermined pressure, the valve elements 41 of the cap covers 32 on both sides of the cylinder barrel 2 open the relieving passages 29 to the outside of the cylinder barrel 2. Further, the balls 53 of the second pressure relieving valves 48 are moved by the pressure in the fluid passages 49 against the urging force of the springs 54, and the valve spaces 50 and fluid passages 52 communicate with the space 15 via the fluid passages 49. Therefore, the pressurized fluid in the space 15 escapes to the outside of the cylinder barrel 2 through the second relieving passages 52 as well as through the relieving passages 29.

When the fluid pressure in the space 15 decreases due to the fluid escaping through the relieving passages 29 and 52, the balls 53 of the second pressure relieving valve are urged by the spring 54 and resume their original position blocking the fluid passages 49. However, as explained before, the cap covers 32 remain at open positions to indicate that the pressure in the space has increased. The rodless power cylinder 1 can be reused by returning the cap covers 32 to their original positions if the rodless power cylinder 1 is not damaged.

In the present invention, the number and the position of the pressure relieving valve is not limited to those in the above embodiments. Further, in the embodiment of FIGS. 8 and 9, the second pressure relieving valves 48 on the mount 11 may be constructed as a type similar to the cap cover 32. In this case, the cap cover 32 on the end caps 5 may be omitted.

As explained above, according to the present invention, a simple and effective means for preventing damage to the rodless power cylinder, when a large amount of fluid leaks from the inner seal band, while preventing damage to the seal bands caused by the incursion of dust into the space between the seal bands, is provided.

I claim:

1. A rodless power cylinder comprising:

a cylinder barrel provided with a slit which penetrates the wall of the cylinder barrel and extends parallel to the axis of the cylinder barrel;

a piston member, having two ends, disposed in the bore of the cylinder barrel and movable therein in the longitudinal direction of the cylinder barrel;

pressure chambers defined by the piston within the bore of the cylinder barrel on both sides of the piston for receiving pressurized fluid therein;

an external carriage disposed outside of the cylinder barrel and coupled to the piston by a coupling member through the slit of the cylinder barrel so that said carriage moves with the piston member along said slit;

an inner seal band disposed on the wall of the bore of the cylinder barrel along said slit in such a manner that the opening of the slit on the wall of the bore of the cylinder barrel is covered by said inner seal band;

an outer seal band disposed on the outer surface of the cylinder barrel along said slit in such a manner that the opening of the slit on the outer surface of the cylinder barrel is covered by said outer seal band, said slit defining a space between the inner and outer seal bands; and pressure relieving means for isolating the space from the outside of the cylinder barrel when the pressure in the space is lower than a predetermined value and for relieving fluid in the space to the outside of the cylinder barrel when the pressure in the space reaches the predetermined value.

2. A rodless power cylinder according to claim 1, wherein said relieving means comprise a relieving passage communicating the space between the inner and the outer seal band to the outside of the cylinder barrel and a pressure relieving valve disposed on the relieving passage and opening when the pressure in the space reaches the predetermined value.

3. A rodless power cylinder according to claim 2, wherein end cap members are provided at both end portions of the cylinder barrel, and the relieving passages are formed in said end cap members.

4. A rodless power cylinder according to claim 2, wherein said relieving passage is formed in the external carriage.

5. A rodless power cylinder according to claim 2, wherein said pressure relieving valve is provided with indicating means for indicating whether the pressure relieving valve is open.

6. A rodless power cylinder according to claim 5, wherein a valve element of the pressure relieving valve functions as said indicating means.

7. A rodless power cylinder according to claim 6, wherein said relieving passage has an end portion which opens to the outside of the cylinder barrel, and said valve element comprises an elastic member which elastically engages the end portion and blocks the opening of the end portion of the relieving passage in such a manner that said elastic member is disengaged from the end portion by the fluid pressure in the space between the seal bands when the fluid pressure in the space reaches the predetermined pressure.

8. A rodless power cylinder according to claim 3, wherein said pressure relieving valve is provided with indicating means for indicating whether the pressure relieving valve is open.

9. A rodless power cylinder according to claim 8, wherein a valve element of the pressure relieving valve functions as said indicating means.

10. A rodless power cylinder according to claim 9, wherein said relieving passage has an end portion which opens to the outside of the cylinder barrel, and said valve element comprises an elastic member which elastically engages the end portion and blocks the opening of the end portion of the relieving passage in such a manner that said elastic member is disengaged from the end portion by the fluid pressure in the space between the seal bands when the fluid pressure in the space reaches the predetermined pressure.

11. A rodless power cylinder according to claim 4, wherein said pressure relieving valve is provided with indicating means for indicating whether the pressure relieving valve is open.

12. A rodless power cylinder according to claim 11, wherein a valve element of the pressure relieving valve functions as said indicating means.

13. A rodless power cylinder according to claim 12, wherein said relieving passage has an end portion which opens to the outside of the cylinder barrel, and said valve element comprises an elastic member which elastically engages the end portion and blocks the opening of the end portion of the relieving passage in such a manner that said elastic member is disengaged from the end portion by the fluid pressure in the space between the seal bands when the fluid pressure in the space reaches the predetermined pressure.

14. A rodless power cylinder according to claim 1, wherein air is used as said fluid.

* * * * *